US009334660B2

(12) United States Patent
Nelson et al.

(10) Patent No.: US 9,334,660 B2
(45) Date of Patent: May 10, 2016

(54) ACCESS PANELS

(71) Applicant: HOMER TLC, INC., Wilmington, DE (US)

(72) Inventors: Michael Nelson, Peachtree City, GA (US); Scott Seccuro, McDonough, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 0 days.

(21) Appl. No.: 13/838,809

(22) Filed: Mar. 15, 2013

(65) Prior Publication Data

US 2014/0259949 A1 Sep. 18, 2014

(51) Int. Cl.
*E04F 19/08* (2006.01)

(52) U.S. Cl.
CPC ..... *E04F 19/083* (2013.01)

(58) Field of Classification Search
CPC ..... E06B 3/01; E06B 3/82; E06B 5/00; E06B 5/003; E04F 19/08; E04F 19/083
USPC ..... 49/463, 465, 50, 56, 67, 397, 400, 401, 49/402, 501
See application file for complete search history.

(56) References Cited

U.S. PATENT DOCUMENTS

| | | | | |
|---|---|---|---|---|
| 2,156,110 | A * | 4/1939 | Brukner | 244/129.4 |
| 3,930,338 | A * | 1/1976 | Rood | 49/465 |
| 4,970,836 | A | 11/1990 | Brown | 52/221 |
| 5,361,541 | A * | 11/1994 | Szyjkowski | 49/465 |
| 5,765,312 | A * | 6/1998 | Szyjkowski | 49/465 |
| 6,618,996 | B1 * | 9/2003 | Szyjkowski | 49/465 |
| 6,830,274 | B2 | 12/2004 | Burkhardt et al. | 296/1.06 |
| 7,095,609 | B2 | 8/2006 | Erickson et al. | 361/683 |
| D611,170 | S | 3/2010 | Hiner | D25/138 |
| D635,098 | S | 3/2011 | Ismert | D13/152 |
| 2012/0159862 | A1 * | 6/2012 | De Domenico | 49/503 |

FOREIGN PATENT DOCUMENTS

| | | |
|---|---|---|
| CN | 202157523 | 3/2012 |
| CN | 202181713 | 4/2012 |
| SE | 465226 B | 8/1991 |

* cited by examiner

*Primary Examiner* — Katherine Mitchell
*Assistant Examiner* — Catherine A Kelly
(74) *Attorney, Agent, or Firm* — Greenberg Traurig, LLP

(57) ABSTRACT

Structures and methods for access panels. Some include a panel member having an inner side; a mounting member having a portion extending from the inner side at an angle to the inner side; and a retaining member coupled to the mounting member, the retaining member having a length and being biased to be in contact with the inner side along a portion of the length, the retaining member also being capable of flexing away from the inner side.

15 Claims, 5 Drawing Sheets

ACCESS PANELS

BACKGROUND

1. Field of the Invention

The invention relates generally to accessing structures behind walls and, more particularly, but not by way of limitation, to an access panel for covering an opening in a wall without drilling or screwing fasteners into the wall.

2. Description of Related Art

Walls, ceilings, floors, and other structures may contain small openings that are used to access components behind the structures. For example, an opening in a wall may provide a homeowner or contractor access to hidden electrical wiring or plumbing to complete a home improvement or repair project. An access panel may be arranged to cover the opening when access to the components is not needed.

An opening may be located in an area of a home that is highly visible to homeowners or guests. The structures behind the opening may also need to be regularly accessed. In such cases, the access panel attached to the opening may serve dual roles of (a) being a decorative item that blends into the surrounding structure and (b) providing efficient and convenient access to the hidden components. Conventional access panels fail or are less than optimal with respect to one or both of these roles.

SUMMARY

This disclosure includes embodiments of access panels and related methods.

Some embodiments of access panels comprise a panel member having an inner side; a mounting member having a portion extending from the inner side at an angle to the inner side; and a retaining member coupled to the mounting member, the retaining member having a length and being biased to be in contact with the inner side along a portion of the length, the retaining member also being capable of flexing away from the inner side. In some embodiments, the retaining member comprises a curved end portion. In some embodiments, the panel member has an upper edge and a lower edge and the retaining member extends along the inner side substantially from the lower edge to the upper edge. In some embodiments, the panel member has an outer side opposing the inner side, the retaining member is coupled to the mounting member with a fastener and the fastener is concealed from view by the panel member when viewed from the outer side. In some embodiments, the retaining member coupled to the mounting member by a fastener, the fastener configured to bias the retaining member so that a portion of the retaining member is in contact with the inner side.

Some embodiments of access panels comprise a panel member having an upper edge and a lower edge; a mounting member coupled to or integral with the panel member, the mounting member having at least one portion that is closer to the lower edge than to the upper edge; and a retaining member coupled to the mounting member and having a curved end portion configured to facilitate insertion of a structure edge between the retaining member and the inner side of the panel member; where at least one location on the curved end portion of the retaining member is closer to the upper edge than to the lower edge. In some embodiments, the mounting member is unitary with the panel member. In some embodiments, the mounting member and panel member comprise a single molded structure. In some embodiments, the panel member has an inner side, and an outer side opposing the inner side, the retaining member is coupled to the mounting member with a fastener and the fastener is concealed from view by the panel member when viewed from the outer side. In some embodiments, the retaining member extends along the inner side substantially from the upper edge to the lower edge.

Some embodiments of access panels comprise a panel member having an outer perimeter; a mounting member coupled to or integral with the panel member, the mounting member having at least one mounting member width and at least one mounting member length; and a retaining member coupled to the mounting member and having at least one retaining member width and at least one retaining member length, the at least one retaining member width being less than the at least one mounting member width, and the at least one retaining member length being greater than the at least one mounting member length; where no portion of the mounting member extends beyond the outer perimeter of the panel member, and no portion of the retaining member extends beyond the outer perimeter of the panel member. In some embodiments, the mounting member is unitary with the panel member. In some embodiments, the mounting member and panel member comprise a single molded structure. In some embodiments, the panel member has an inner side, and an outer side opposing the inner side, the retaining member is coupled to the mounting member with a fastener and the fastener is concealed from view by the panel member when viewed from the outer side. The access panel, and more specifically the panel member, has a height, and in some embodiments, the retaining member extends along the inner side along a majority of the height.

Some embodiments of access panels comprise a panel member having an inner side, a left edge, and a right edge; a mounting member having a portion extending from the inner side at an angle to the inner side; and a retaining member centered between the left edge and the right edge and coupled to the mounting member, the retaining member configured so that a portion of the retaining member is biased to be in contact with the inner side. In some embodiments, the mounting member is unitary with the panel member. In some embodiments, the mounting member and panel member comprise a single molded structure. In some embodiments, the panel member has an outer side opposing the inner side, the retaining member is coupled to the mounting member with a fastener and the fastener is concealed from view by the panel member when viewed from the outer side. In some embodiments, the retaining member extends along the inner side substantially from the left edge to the right edge. In some embodiments, the retaining member coupled to the mounting member by a fastener, the fastener configured to bias the retaining member so that a portion of the retaining member is in contact with the inner side.

Some embodiments of methods of covering an aperture in a structure with an access panel comprise inserting an edge portion that at least partially defines the aperture between an inner side and a retaining member of an access panel, the retaining member having a leading edge that is curved; moving the access panel relative to the structure to increase the distance between the leading edge of the retaining member and a location on the edge portion, while the edge portion remains between the inner side of the access panel and the retaining member; moving the access panel so that the mounting member of the access panel extends at least partially through the aperture; moving the access panel to decrease the distance between the leading edge of the retaining member and the location on the edge portion so that the mounting member of the access panel contacts the structure and the access panel covers the aperture. In some embodiments, the aperture is covered with the access panel using one hand.

Some embodiments further comprise: moving the access panel relative to the structure to increase the distance between the leading edge of the retaining member and a location on the edge portion, thus exposing a portion of the aperture.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The embodiments of the apparatuses and their components shown in the figures are drawn to scale for at least the embodiment shown, unless stated otherwise.

DESCRIPTION OF ILLUSTRATIVE EMBODIMENTS

Figure 1:
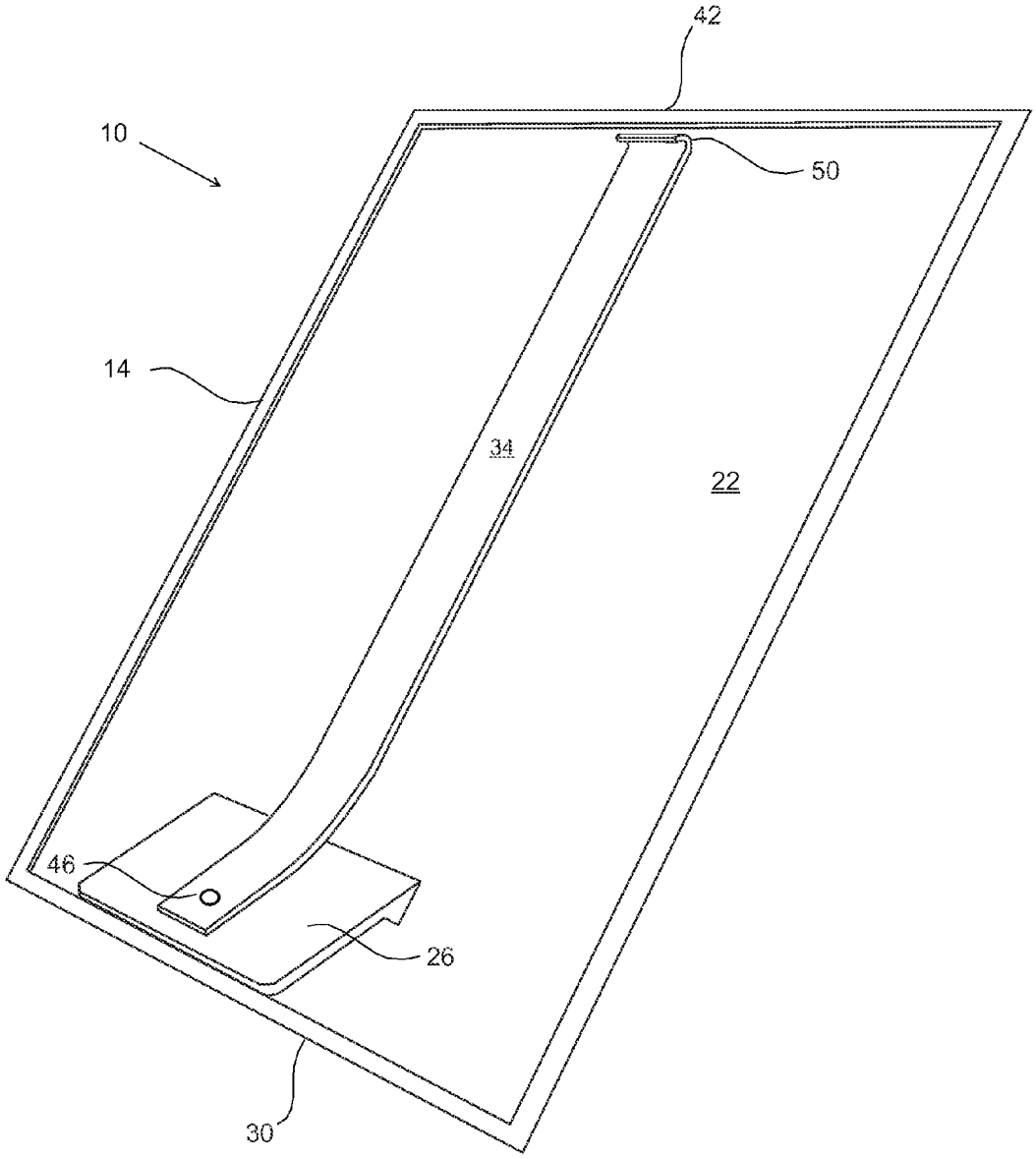
FIG. 1 is a perspective view of an access panel of the present disclosure.

Referring now to the drawings, and more particularly to FIG. 1, shown there is an embodiment of an access panel 10. Panel 10 includes a panel member 14, which is one example of a panel configured to cover an opening in a structure, such as an opening or void in drywall or another sheet of structural material, or to cover materials within a structure, such as piping, wiring, electrical equipment, and the like. Panel 10 has an outer side configured to face away from the opening or void, and/or or materials being covered; and an inner side 22 configured to face toward the opening or void, or material being covered by the access panel. In the embodiment shown, a mounting member or wall rest 26 extends from and at an angle to inner side 22 of panel 10. In the embodiment shown, a wall rest 26 is coupled to panel 10 at a position near an outer edge 30 with the wall rest extending away from the inner side 22 of panel 10 at an angle, and toward outer edge 30. In some embodiments, wall rest 26 may be unitary with panel member 14. For example, panel member 14 and wall rest 26 can comprise a unitary molded or machined piece of plastic, metal, or other material. In other embodiments, wall rest 26 and panel member 14 may be distinct pieces that are rigidly coupled to together, such as by glues, welding, riveting or any other suitable means. In the embodiment depicted in FIG. 1, a retaining member or tension arm 34 is coupled to wall rest 26 and extends vertically (relative to edge 30, which can be considered to correspond to the bottom of panel 10) from wall rest 26 across inner side 22 of panel member 14 to a distal end 38 that is near an opposite outer edge 42 at the top of panel member 14.

In the depicted embodiment, tension arm 34 is affixed to wall rest 26 by a rivet 46 extending through tension arm 34 and wall rest 26. In other embodiments, the tension arm may be coupled to wall rest 26 and/or to panel member 14 by one or more rivets, bolts, welds, adhesives, or other affixing structures. Because wall rest 26 extends away from inner side 22 of panel member 14, affixing structures such as rivets may be hidden from view by the panel member for aesthetic purposes. In the embodiment shown, tension arm 34 comprises a hardened steel, or spring steel arm, but the tension arm may be manufactured of any suitable material. Tension arm 34 is designed to be capable of being flexed away from inner side 22 of panel member 14 to impart a force on a structure two which access panel 10 is coupled, with the force being directed toward inner side 22 of panel member 14. In the embodiment shown, tension arm 34 is pre-tensioned by a bend in tension arm 34 resulting from the angle between wall rest 26 and inner side 22 of panel member 14, such that tension arm 34 is flexed or under elastic tension, with the flexion or elastic tension being increased when distal end 38 of tension arm 34 is flexed away from inner side 22 to install access panel 10 is installed on a structure. In this embodiment, this pre-tensioning causes tension arm 34 to be affirmatively biased toward inner side 22 even when tension arm 34 is at rest against inner side 22.

In some embodiments, such as the one shown, tension arm 34 includes a curved end portion 50 at distal end 38 of tension arm 34. Curved end portion 50 facilitates insertion of a structure edge portion 62 between tension arm 34 and inner side 22 of panel 10, and curved end portion 50 may be sized such that its curvature is sufficient to allow a structure edge of a known thickness to slide under curved end portion 50 between tension arm 34 and inner side 22 of panel 10 without requiring manual flexing of tension arm 34. For example, the curvature, and/or radius of curved end portion 50 may be selected such that it can slip over the edge of a particular thickness of drywall, panel board, sheet metal, or other structural material, which can facilitate installation of panel 10 using only a single hand of a user.

Figure 2:
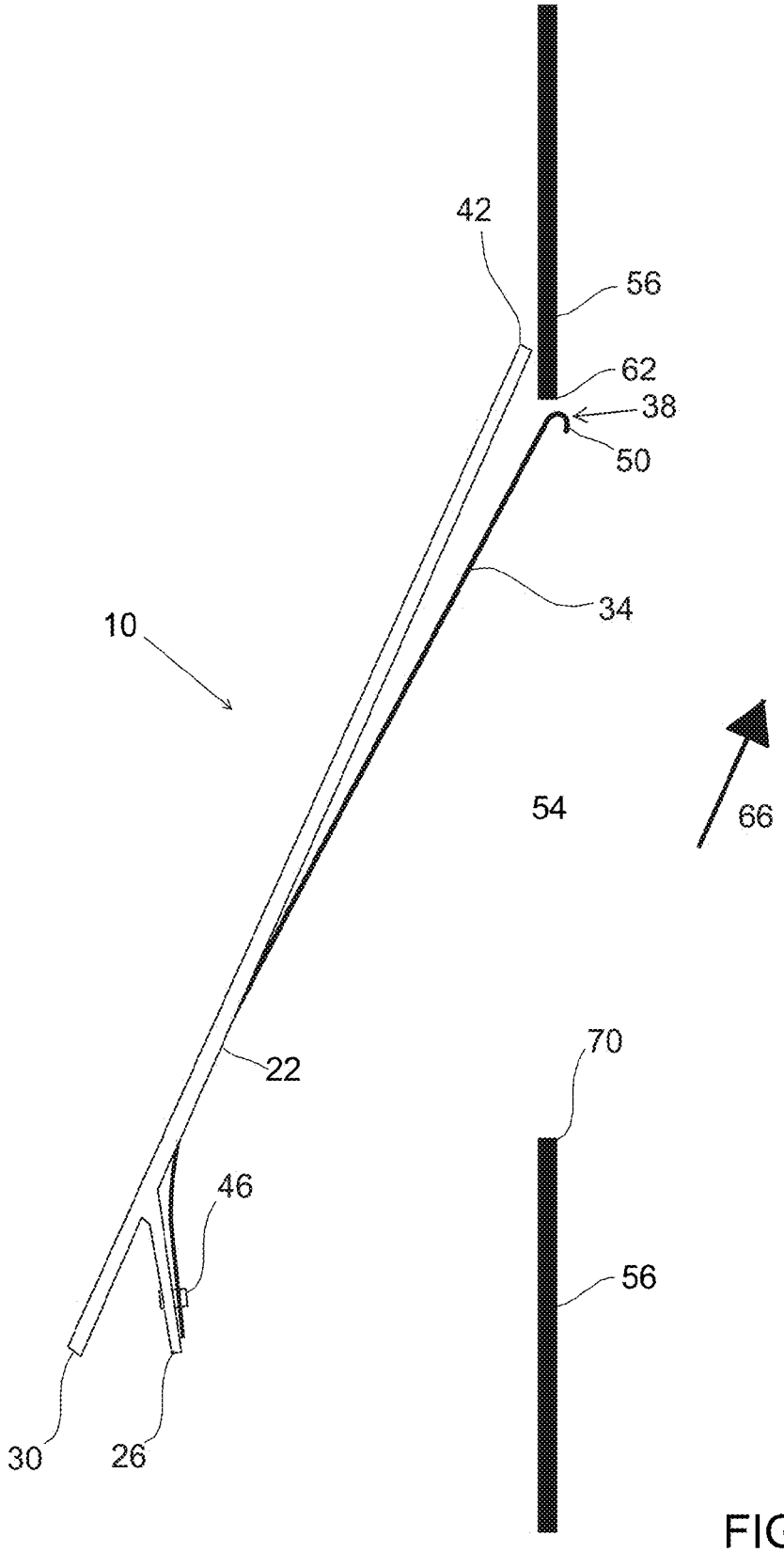
FIGS. 2-4 depict side views of the access panel of FIG. 1, shown in various stages of a method of installing the access panel over an opening in a wall.

Referring now to FIG. 2, a side view is shown of access panel 10 being applied to cover an opening 54 in a wall surface (e.g., a thickness of drywall cladding one side of a studded wall). To initiate application of access panel 10, curved end portion 50 of tension arm 34 is slipped over and behind an edge portion 62 that defines a portion of the opening, such that edge portion 62 is pressed between tension arm 34 and inner side 22 of panel member 14. As described above, curved end portion 50 of tension arm 34 is curbed to facilitate such an insertion of edge portion 62. Panel 10 can then be moved in an upward and/or inward direction 66, which increases the distance between upper or leading edge 42 of panel member 14 and curved end portion 50 of tension arm 34 and, thus, increases the force imparted by tension arm 34 on edge 62 in the direction of inner side 22 of panel member 14.

Figure 3:
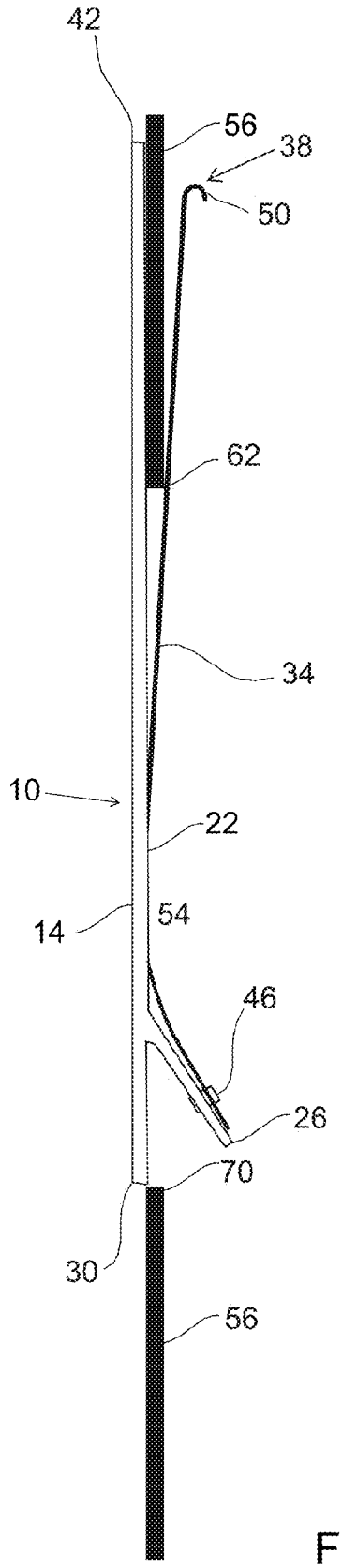

As shown in FIG. 3, to continue application of access panel 10 to cover opening 54, wall rest 26 is inserted at least partially through opening 54 as edge 62 is further inserted between tension arm 34 arm 34 and panel member 14, and as access panel 10 is rotated toward wall 56 such that inner side 22 rests against an outer surface of wall 56. Tension arm 34 thus continues to impart a force on at least edge 62 of and/or on an inner surface of wall 56 near edge 62 of opening 54.

Figure 4:
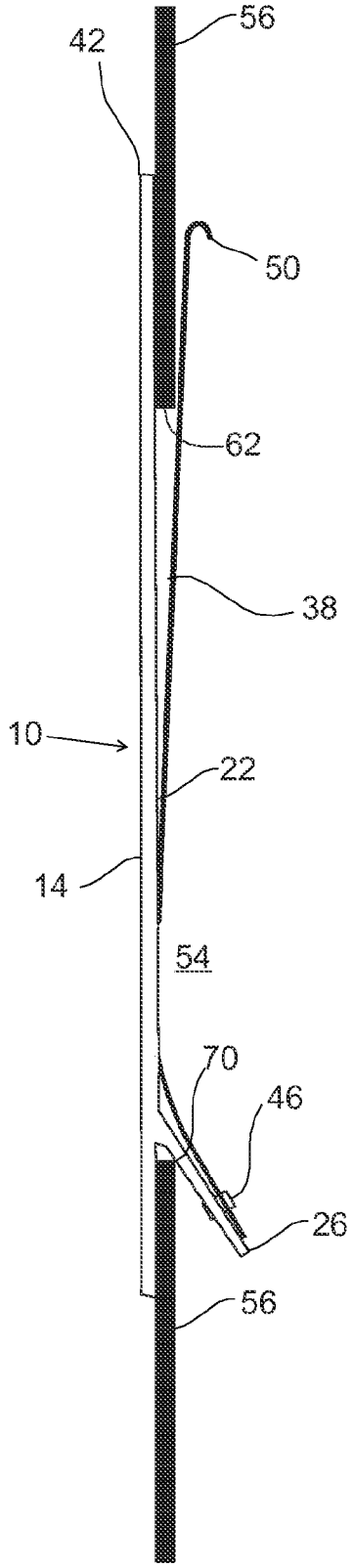

Next, and as depicted in FIG. 4, access panel 10 is lowered such that an edge 70 at the bottom of opening 54 is disposed between panel member 14 and wall rest 26, and such that wall rest 26 contacts edge 70. Access panel 10 is thus moved downward until wall rest 26 rests on edge 70 to support access panel 10 in the installed position of FIG. 4. In the embodiment shown, wall rest 26 is configured to be of sufficient length that it extends downward past edge 70 to resist outward movement of panel member 14 relative to wall 56. In other embodiments, wall rest 26 may be configured such that its lower edge does not extend below edge 70 that defines the bottom of opening 54.

In the embodiment shown, once access panel 10 is installed on wall 56 to cover opening 54, as shown, the size of opening 54 is such that access panel 10 may be moved upward such that edge 62 of wall descends between tension arm 34 and panel member 14, and a space between the bottom of panel member 14 and edge 70 may be opened to permit access to the area behind opening 54 without fully removing access panel 10 from wall 56. Once access is no longer desired, access panel 10 may be moved downward until wall rest 26 again contacts edge 70, thus covering the opening.

Figure 5:
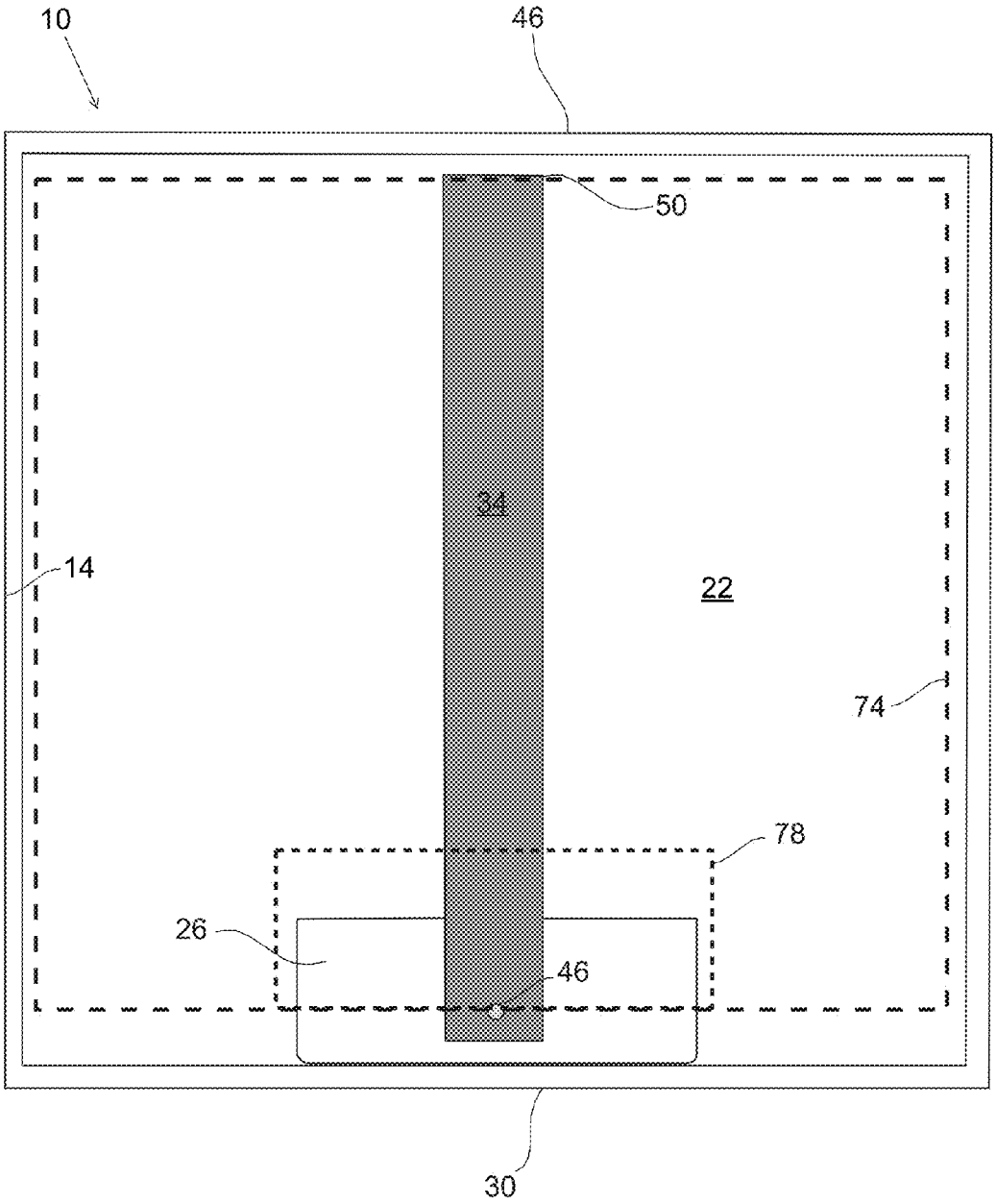
FIG. 5 is a rear side view of the access panel of FIG. 1, shown relative to several opening geometries over which the access panel can be installed.

FIG. 5 depicts a rear side view of access panel 10 facing inner side 22. As described above, tension arm 34 is coupled to wall rest 26 and extends vertically (relative to edge 30, which can be considered to correspond to the bottom of panel 10) from wall rest 26 across inner side 22 of panel member 14 to a distal end 38 that is near an opposite outer edge 42 at the top of panel member 14. This arrangement of tension arm makes the access panel suitable for covering openings of a variety of sizes and geometries, for example, as long as the outer perimeter of the opening falls within the outer perimeter of panel member 14. For example, the access panel is capable of being fitted to cover openings having the geometry indicated by boundary 74, while being equally suited to openings having a much smaller geometry indicated by boundary 78, and various other geometries, without requiring that access panel 10 be reconfigured.

For example, wall rest 26 can have any number of differing geometries so long as it is capable of resting against an edge of a wall defining an opening over which the access panel is fitted. Wall rest 26 may therefore be positioned in any of many positions so long as it is coupled panel and extends from inner side 22. For example, in some embodiments, it is only important that wall rest 26 be positioned such that at least a portion of wall rest 26 is closer to lower outer edge 30 than to upper outer edge 42. Tension arm 34 may also be provided with various configurations. For example, tension arm 34 can be coupled to wall rest 26 at another location, or may be instead coupled to inner side 22 of panel member 14. Tension arm 34 may also be configured to extend only partially across inner side 22 of panel member 14, rather than extending across a majority of inner side 22, as in the depicted embodiment. Other embodiments also comprise multiple tension arms, and/or tension arms with various features and shapes.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the devices are not intended to be limited to the particular forms disclosed. Rather, they include all modifications and alternatives falling within the scope of the claims, and embodiments other than the one shown may include some or all of the features of the depicted embodiment. For example, components may be omitted or combined as a unitary structure, and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An access panel comprising:

a panel member having an inner side;

a mounting member having a portion extending from the inner side at an acute angle to the inner side; and a retaining member coupled to the mounting member, the retaining member having a length and being biased to be in contact with the inner side along a portion of the length, the retaining member also being capable of flexing away from the inner side;

where the retaining member is distinct from the mounting member and coupled to the mounting member at the portion of the mounting member extending from the inner side, and the mounting member is positioned so that, when the access panel is used to cover an opening in a structure, an edge of the structure is positioned between the inner side of the panel member and the mounting member; and where the access panel is configured to be removed from covering an opening in a structure by first shifting the panel member in a direction along the length of the retaining member.

2. The access panel of claim 1, where the retaining member comprises a curved end portion.

3. The access panel of claim 1, where the panel member has an upper edge and a lower edge and the retaining member extends along the inner side substantially from the lower edge to the upper edge.

4. The access panel of claim 1, where the panel member has an outer side opposing the inner side, the retaining member is coupled to the mounting member with a fastener and the fastener is concealed from view by the panel member when viewed from the outer side.

5. The access panel of claim 1, where the retaining member coupled to the mounting member by a fastener, the fastener configured to bias the retaining member so that a portion of the retaining member is in contact with the inner side.

6. An access panel comprising:

a panel member having an inner side, an upper edge, and a lower edge;

a mounting member coupled to or integral with the panel member, the mounting member having at least one portion that is closer to the lower edge than to the upper edge; and a retaining member having at least one length, at least one width, and a curved end portion configured to facilitate insertion of a structure edge between the retaining member and the inner side of the panel member, the retaining member being directly affixed to the mounting member so that a position of the retaining member remains fixed relative to a position of the panel member in a direction along the at least one length of the retaining member and in a direction along the at least one width of the retaining member;

where at least one location on the curved end portion of the retaining member is closer to the upper edge than to the lower edge, and the mounting member is positioned so that, when the access panel is used to cover an opening in a structure having the structure edge, another edge of the structure is positioned between the inner side of the panel member and the mounting member.

7. The access panel of claim 6, where the mounting member is unitary with the panel member.

8. The access panel of claim 7, where the mounting member and panel member comprise a single molded structure.

9. The access panel of claim 6, where the panel member has an outer side opposing the inner side, the retaining member is affixed to the mounting member with a fastener and the fastener is concealed from view by the panel member when viewed from the outer side.

10. The access panel of claim 6, where the retaining member extends along the inner side substantially from the upper edge to the lower edge.

11. An access panel comprising:

a panel member having an outer perimeter and an inner surface;

a mounting member coupled to or integral with the panel member, the mounting member having at least one mounting member width and at least one mounting member length and a mounting member outer surface facing away from the inner surface of the panel member; and a retaining member coupled to the mounting member and having at least one retaining member width and at least one retaining member length, the at least one retaining member length being greater than the at least one retaining member width, the at least one retaining member width being less than the at least one mounting member width, and the at least one retaining member length being greater than the at least one mounting member length, the retaining member having a retaining member inner surface facing the inner surface of the panel;

where no portion of the mounting member extends beyond the outer perimeter of the panel member, and no portion of the retaining member extends beyond the outer perimeter of the panel member, and where the retaining member inner surface is fixed to the mounting member outer surface; and where the access panel is configured to be removed from covering an opening in a structure by first shifting the panel member in a direction along the at least one retaining member length.

12. The access panel of claim 11 where the mounting member is unitary with the panel member.

13. The access panel of claim 12, where the mounting member and panel member comprise a single molded structure.

14. The access panel of claim 11, where the panel member has an inner side, and an outer side opposing the inner side, the retaining member is coupled to the mounting member with a fastener and the fastener is concealed from view by the panel member when viewed from the outer side.

15. The access panel of claim 14, where the panel member has a height and the retaining member extends along the inner side along a majority of the height.

* * * * *